US006149710A

United States Patent [19]

Gonzalez et al.

[11] Patent Number: 6,149,710

[45] Date of Patent: Nov. 21, 2000

[54] ADDITIVE FOR ADDING ONE OR MORE METALS INTO ALUMINIUM ALLOYS

[75] Inventors: Aitor Arco Gonzalez, Bilbao; Francisco Diaz Maruri, Abanto; Tomas Posada Fernandez, Mungia; Javier Eluztondo Amorrortu, Algorta-Gexto, all of Spain

[73] Assignee: Bostlan, S.A., Mungia, Spain

[21] Appl. No.: 09/075,398

[22] Filed: May 11, 1998

[30] Foreign Application Priority Data

May 9, 1997 [ES] Spain ..... 9700995

[51] Int. Cl.[7] ..... C22B 21/00; C22B 21/02

[52] U.S. Cl. ..... 75/684; 75/315; 75/316; 75/255; 420/590

[58] Field of Search ..... 75/315, 684, 314, 75/316, 255; 420/590; 419/65

[56] References Cited

U.S. PATENT DOCUMENTS

| | | | |
|---|---|---|---|
| 3,898,076 | 8/1975 | Ranke | 149/4 |
| 4,225,343 | 9/1980 | Guarino et al. | 75/315 |
| 4,880,462 | 11/1989 | Meyer-Grunow | 75/304 |
| 5,064,463 | 11/1991 | Ciomek | 75/315 |
| 5,951,737 | 9/1999 | Lefebvre et al. | 75/252 |

FOREIGN PATENT DOCUMENTS

| | | |
|---|---|---|
| 510842 A3 | 10/1992 | European Pat. Off. . |
| 2170186 | 9/1973 | France . |
| 2511351 | 9/1976 | Germany . |
| 2267455 | 12/1993 | United Kingdom . |

*Primary Examiner*—Daniel J. Jenkins
*Assistant Examiner*—Tima McGuthry-Banks
*Attorney, Agent, or Firm*—Browdy and Neimark, P.L.L.C.

[57] ABSTRACT

Briquettes or tablets to be added to an aluminium melt, are made up by the combination of an agglutinated powder which include, at least, an aluminium powder, a powder of one or more metals or alloys including those to be added, and a wax-type organic compound, all in adequate proportions. This combination allows the increase of the dissolution velocity of the added metals, the recoveries of the added metal, a better stirring of the melting aluminium, and the reduction of impurities and of accumulated metal in the bottom of the furnace.

17 Claims, 2 Drawing Sheets

ADDITIVE FOR ADDING ONE OR MORE METALS INTO ALUMINIUM ALLOYS

FIELD OF INVENTION

This invention relates to an additive for adding one or more metals in aluminium alloys, as well as the way the metals are added into aluminium undergoing melting or a melt thereof.

BACKGROUND

The use of fluxes such as fluorides, chlorides and carbonates in the alloy tablets in this industrial application presents some drawbacks related to the significant environmental problems they produce, and to the presence of inclusions in the obtained alloys. Thus, new fluxes of different characteristics are necessary in order to improve the features of the metals dissolution in relation to those given by the tablets currently used.

The published patents U.S. Pat. No. 4,880,462, U.S. Pat. No. 4,564,393 and UK-A-2.112.020 present an additive for this application, but the flux is of hazardous nature and makes undesirable inclusions in the aluminium can still be formed.

Patent GB-A-2.267.455 proposes the application of waxes in a different field: the powder metallurgy.

SUMMARY OF INVENTION

When inserted into the melting aluminium, the additive of this invention yields important improvements, as noted in the following aims or objectives:

an aim of the invention is an additive for increasing the dissolution velocity of the added metals.

another aim of the invention is an additive for increasing the recovery of the added metals.

another aim of the invention is an additive for producing a stirring effect in the melting aluminium, in order to increase the homogeneous distribution of the metal throughout the whole alloy.

another aim of the invention is to provide a reduction of the impurities in the melting aluminium, since the produced gases promote their buoyancy.

finally, another aim of the invention is to reduce the amount of added metal accumulated in the bottom of the furnace.

In order to carry out their objectives, the invention claims an additive for adding one or more metals to the aluminium alloys. This additive contains:

(a) an agglutinating powder, for example, commercial powder aluminium, magnesium or an alloy or mixture of both of them, (b) a powder of one or more metals or alloys comprising that or those to be added, for example, manganese, chromium, tungsten, molybdenum, titanium, vanadium, iron, cobalt, copper, niobium, nickel, tantalum, zirconium, hafnium, silver, lead, zinc, and, (c) a wax-type organic compound.

DETAILED DESCRIPTION OF EMBODIMENTS

Figure 1A:
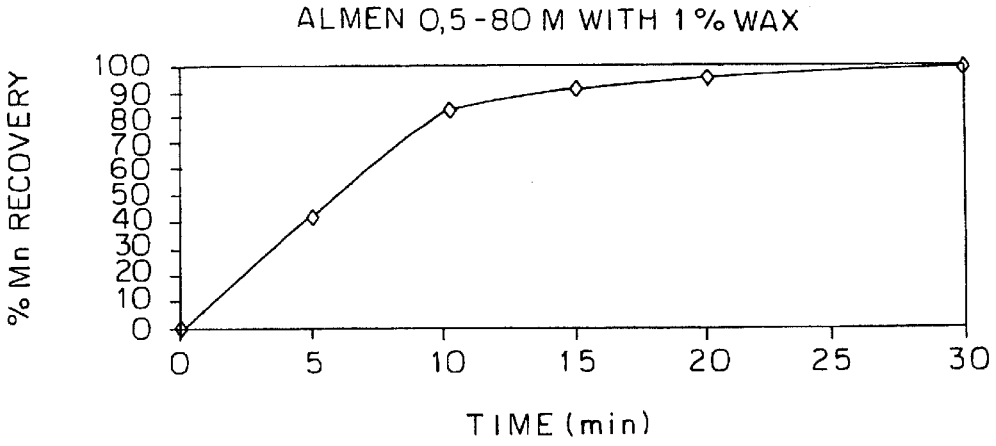
FIGS. 1A, 1B and 1C are graphs of results of example 1.

The weight proportions in the final mixture are:

(a) from 49.9% to 0%

(b) from 50% to 95%

(c) from 0.1% to 5%.

Any aluminium alloy containing acceptable amounts of materials with an otherwise unfavourable effect in the final aluminium alloy can be used as the component (a), but it is better to use as pure as possible aluminium, so commercially pure aluminium is recommended for component (a).

The best weight proportion (A) for the aluminium component should satisfy $A \leqq 49.9\%$. A proportion about 20% is preferred.

These additives are used in order to add metals of higher melting point than that of the aluminium into the melting aluminium, for example, manganese, chromium, tungsten, molybdenum, titanium, vanadium, iron, cobalt, copper, niobium, nickel, tantalum, zirconium, hafnium, and silver, and, especially, manganese, chromium, titanium, iron and copper. The metallic component added is usually formed by one or more commercially pure metals, but it can be one or more alloys of such metals, taking into account that this alloy or alloys should not lead to unacceptable amounts of undesirable compounds into the melting aluminium.

If different metals have to be added into the melting aluminium at the same time, one or more metals can be added using an additive according to this invention, and other procedures can be used for inserting the rest of the metals. The different metals to be added by means of an additive according to this invention should be present in the additive as:

(1) a mixture of the powders of the metals (2) a powder of an alloy of the metals (3) a mixture of the powders of, at least one alloy and at least one metal.

The weight proportion (B) for the component (b) should satisfy the condition: $50\% < B < 95\%$. This condition makes the metallic component (b) to reach reasonable concentrations in the additive whereas high dissolution rates and recoveries of the added metal are obtained. A proportion between 75% and 80% is preferred for B.

The flux must be a wax. Any kind of wax can be used, but it should rather be a non-polar one. More specifically, a wax with no impurities being harmful for the melting aluminium, for example, paraffin or polyethylene waxes, should be used.

We have found the best results for a weight proportion C of the component (c) satisfying the condition $0\% \leqq C \leqq 5\%$, preferably in the range $0.3\% \leqq C \leqq 1\%$, C values less than 0.3% proudce clearly minor benefits than the maximum, and C values higher than 5% are not desirable, since smoke from the combustion of the wax is produced, dross appears on the surface of the melting aluminium, and hydrogen and carbon are inserted into the aluminium.

According to this invention, a highly recommended additive includes commercially pure aluminium for the component (a), with A values about 19%, B values about 80% and C values about 1%. The more desirable products for the additives described in this paragraph are commercially pure chromium, commercially pure manganese, commercially pure iron or commercially pure titanium.

The particle sizes of the aluminium component and that of the added metal component should preferably be less than 1 mm. The size of the wax particles should preferably be less than 0.5 mm.

Components are easier to insert and maintain into the melting aluminium when they are added by means of a body formed by compression of its components. Such bodies should be formed by compressing powdered mixtures of components (a), (b) and (c) using, for example, a press or an horizontal hydraulic machine for produce tablets.

The melting aluminium bath to be alloyed can be commercially pure, which is usually known as primary aluminium, or an alloy from a secondary melting.

In order to provide a better understanding of the invention some examples and claims are enclosed.

EXAMPLE 1

Three mixtures with the following weight proportions of the components were prepared:

(b) 80% of electrolytic manganese powder with 0.55% oxidation level.

(c) 0%, 0.5% and 1% of paraffin wax.

(a) 20%, 19.5% and 19% of aluminium powder, respectively.

The mixtures were pressed in a vertical hydraulic press to give them a tablet shape, with about 90 mm diameter and 25 mm height. The tablets contained exactly 500 g of manganese and the total weight was about 625 g. The tablets were named ALMEN 0.5-80M.

Three independent experiments were performed in a 50 Kg capacity electric melting furnace. The initially added charge was 50 Kg of 1070 aluminium alloy. After melting of the aluminium, temperature was adjusted to 720° C. The dross was removed from the surface and the blank sample was taken. The referred tablets were added and it was observed that the bigger the proportion of wax in the added sample, the higher stirring effect obtained into the melting aluminium. The aluminium bath was adequately stirred and control samples were taken in order to know the dissolution process of the manganese into the aluminium as a function of time. The plots show the results obtained.

Figure 1B:
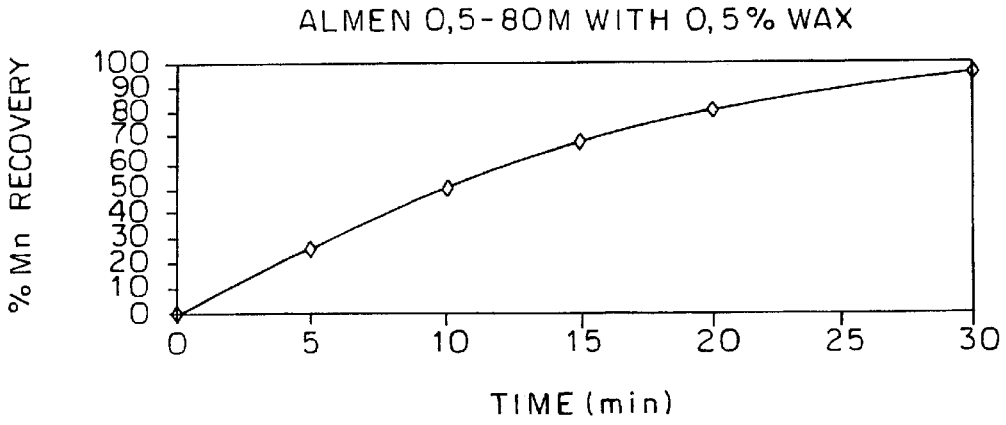
Figure 1C:
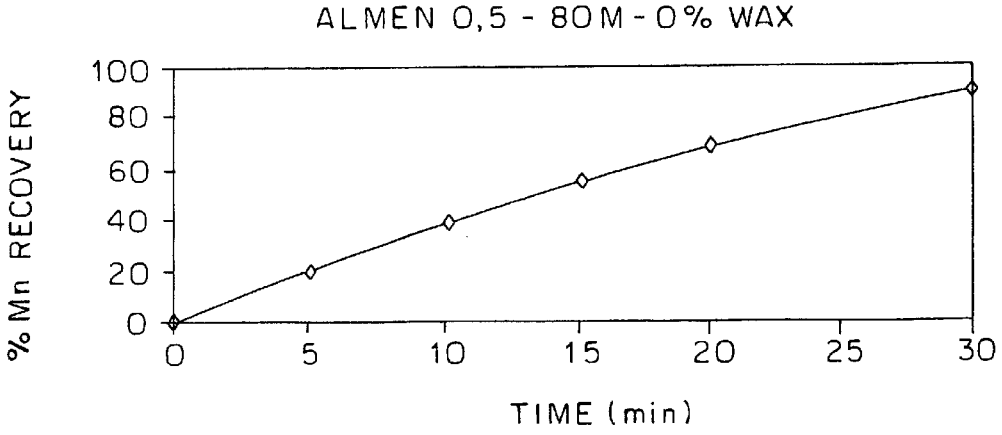

It can be seen in FIGS. 1A, 1B and 1C that high levels of wax in the tablet imply a faster dissolution process and a higher final manganese recovery.

The initial and final levels of manganese in the melting aluminium, as well as the temperatures registered during the three different processes are completely comparable.

EXAMPLE 2

Two mixtures with the following weight proportions of the components were prepared:

(b) 75% of electrolytic manganese powder.

(c) 0%, and 0.5% of paraffin wax.

(a) 25% and 24.5% of aluminium powder, respectively.

The mixtures were pressed in an horizontal hydraulic press to give them a briquette shape, with about 40.5 mm diameter and 40 mm height. The total weight of the briquettes is 200 g and they contain 150 g of manganese. The briquettes were named ALMEN 275M.

Two independent experiments were performed in a 10 metric tons oxyfuel furnace. About 9 metric tons of 1070 aluminium alloy were added to the furnace in order to obtain a commercial 3003 aluminium. After melting of the aluminium in the melting furnace, aluminium was transferred to a holding furnace, where temperature was adjusted to about 720° C. for both experiments. At that time, surface dross was removed and a blank sample was taken. 120 briquettes were added, and similar phenomena to those in the Example 1 were observed. Aluminium was adequately stirred, and control samples were taken in order to know the dissolution process of the manganese briquettes into the aluminium as a function of time.

Figure 2A:
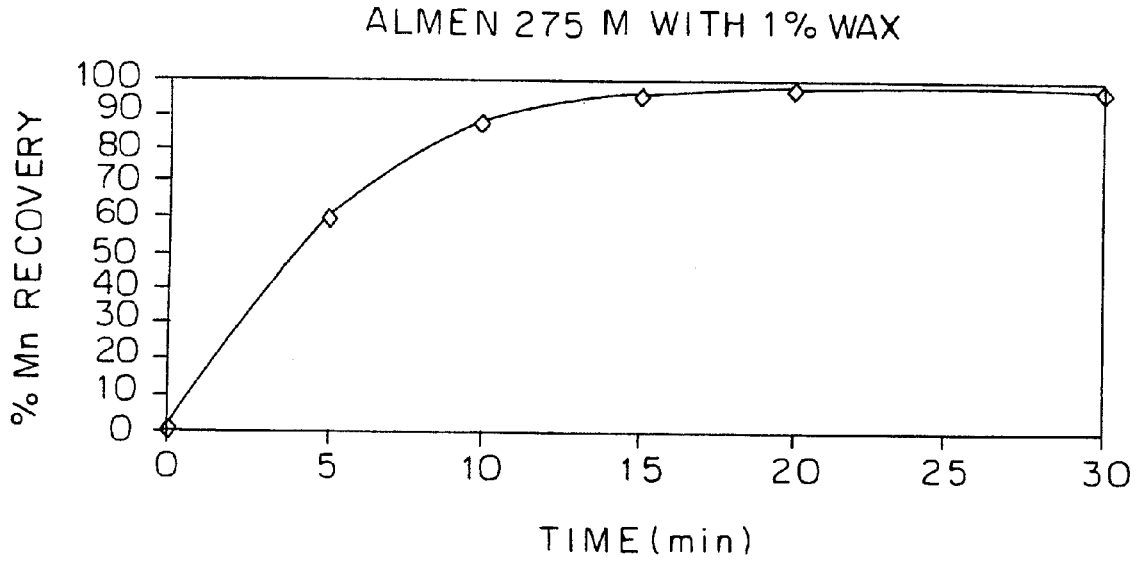
FIGS. 2A and 2B are graphs with respect to example 2.
Figure 2B:
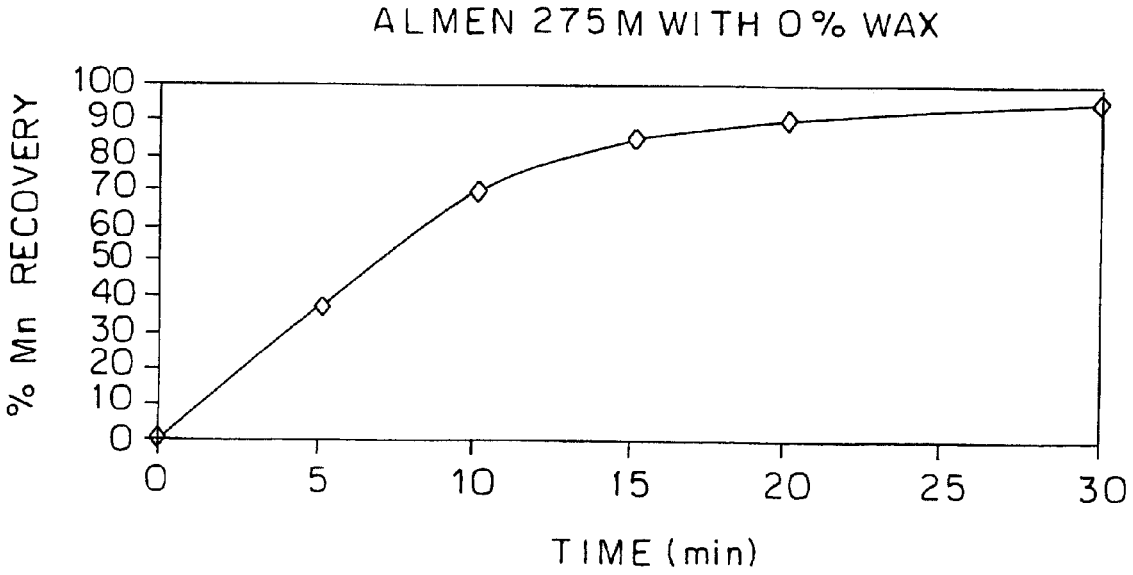

It can be seen in FIGS. 2A and 2B that high levels of wax in the tablet imply a faster dissolution process and a higher final manganese recovery.

The nature and advantages of this invention are described and it should be pointed out its unlimited character, so changes in shape, material or dimensions will not modify in any case the substantiality of the invention, if significant variations of the whole are not performed.

The points of the invention presented in order to be object of the Patent of Invention will be related to 'Additive for adding one or more metals into aluminium alloys' according to the following claims.

We claim:

1. An additive for adding one or more metals in aluminum alloys which consists essentially of (a) an agglutinating powder comprising aluminum, magnesium or a mixture or alloy thereof, (b) a powder of one or more metals or alloys of manganese, chromium, tungsten, molybdenum, titanium, vanadium, iron, cobalt, copper, niobium, nickel, tantalum, zirconium, hafnium, silver, lead or zinc, (c) a binder in an amount of 0.1 to 1% consisting essentially of a non-polar organic wax and substantially free of any other binder, wherein the following weight proportions in the final mixture are from 49.9% to 0% for component (a), from 50% to 95% for component (b) and from 0.1% to 5% for binder component (c).

2. The additive of claim 1, in which the component (a) is a powder of aluminium in an amount, based on the total composition of (a), (b) and (c), of about 19–25%.

3. The additive of claim 1, in which the component (a) is present as a powder of aluminium and magnesium.

4. The additive of claim 1, in which the component (a) is present as a powder of magnesium.

5. The additive of claim 1, wherein said component (a) is present as a powder of substantially pure aluminium.

6. The additive of claim 1, wherein said powder (b) comprises manganese.

7. The additive of claim 1, wherein said powder (b) comprises at least one of chromium, titanium, iron and copper.

8. The additive of claim 1, wherein said component (b) is present in an amount between 75% and 80%.

9. The additive of claim 1, wherein said binder of a non-polar wax consists essentially of paraffin or a polyethylene wax.

10. The additive of claim 1, wherein component (a) consists essentially of substantially pure aluminium in an amount of about 19%, component (b) is present in an amount of about 80%, and component (c) is present in an amount of about 1%.

11. The additive of claim 10, wherein component (b) is substantially pure chromium, substantially pure manganese, substantially pure iron or substantially pure titanium.

12. In a process of forming an aluminium alloy comprising adding at least one alloying metal to aluminium undergoing melting or a melt thereof, the improvement wherein said alloying metal is present in the form of a briquette or tablet which contains (a) up to 49.9% of an agglutinating powder comprising aluminium, magnesium or a mixture or alloy thereof;

(b) 50% to 95% of a powder of one or more of said alloying metals or alloys thereof, said alloying metals comprising manganese, chromium, tungsten, molybdenum, titanium, vanadium, iron, cobalt, copper, niobium, nickel, tantalum, zirconium, hafnium, silver, lead or zinc, and (c) from 0.1% to 5% of a non-polar organic wax.

13. The process of claim 12, wherein component (a) of said tablet or briquette is present in an amount of about 19–25% and comprises aluminium.

14. The process of claim 12, wherein component (c) of said tablet or briquette comprises paraffin or a polyethylene wax.

15. The process of claim 14, wherein said component (c) of said tablet or briquette is present in an amount of between 0.3% and about 1%.

16. The process of claim 12, wherein said component (b) in said briquette or tablet comprises at least one of manganese, chromium, titanium, iron and copper.

17. The process of claim 12, wherein said component (b) of said tablet or briquette is substantially pure manganese, substantially pure iron or substantially pure titanium.

* * * * *